US009816349B2

(12) United States Patent
Armistead

(10) Patent No.: US 9,816,349 B2
(45) Date of Patent: Nov. 14, 2017

(54) INFLATABLE CASING VALVE

(71) Applicant: George Taylor Armistead, Katy, TX (US)

(72) Inventor: George Taylor Armistead, Katy, TX (US)

(73) Assignee: CHEVRON U.S.A. INC., San Ramon, CA (US)

( * ) Notice: Subject to any disclaimer, the term of this patent is extended or adjusted under 35 U.S.C. 154(b) by 532 days.

(21) Appl. No.: 14/536,917

(22) Filed: Nov. 10, 2014

(65) Prior Publication Data

US 2016/0130909 A1 May 12, 2016

(51) Int. Cl.
*E21B 34/10* (2006.01)
*E21B 33/06* (2006.01)

(52) U.S. Cl.
CPC ..... *E21B 34/10* (2013.01); *E21B 33/06* (2013.01)

(58) Field of Classification Search
CPC ..... E21B 34/10; E21B 34/102; E21B 34/00; E21B 33/06; E21B 33/08; E21B 33/127; E21B 33/1295
See application file for complete search history.

(56) References Cited

U.S. PATENT DOCUMENTS 1,772,210 A * 8/1930 Dale ..... E21B 33/08 24/DIG. 26
3,737,139 A * 6/1973 Watts ..... F16L 17/10 251/1.2
4,718,495 A * 1/1988 Lubitz ..... E21B 33/02 166/120
2006/0278281 A1* 12/2006 Gynz-Rekowski ..... E21B 33/10 137/554
2012/0234558 A1* 9/2012 Godfrey ..... E21B 34/10 166/374
2013/0025887 A1* 1/2013 Richard ..... E21B 33/1285 166/387

* cited by examiner

*Primary Examiner* — Wei Wang
(74) *Attorney, Agent, or Firm* — King & Spalding LLP

(57) ABSTRACT

A casing valve is described herein. The casing valve can include at least one wall forming a cavity and at least one flexible sleeve disposed proximate to an inner surface of the at least one wall. The casing valve can also include at least one chamber recessed relative to the inner surface of a top end of the at least one wall, where the at least one chamber is disposed between the at least one flexible sleeve and the at least one wall. The casing valve can further include at least one hydraulic channel disposed within the at least one wall and terminating in the at least one hydraulic chamber. The casing valve can also include a first coupling feature disposed at a top end of the at least one wall, wherein the first coupling feature is configured to couple to a first casing pipe.

19 Claims, 5 Drawing Sheets

INFLATABLE CASING VALVE

TECHNICAL FIELD

The present application relates to casing valves, and in particular, methods and systems of inflatable casing valves.

BACKGROUND

The drilling of an oil, gas, or other type of well requires that an upper casing string be set at some shallower depth than the total depth of the well. Some purposes of the casing string are to protect a portion of the wellbore environment and to protect personnel. When the casing string is set, the drilling operation continues to extend the open hole portion of the wellbore below the casing string. During the drilling process, it can be necessary to pull the drill string out of the wellbore (a process known as "tripping") on one or more occasions. The open hole and casing provides a hydraulic conduit up through the wellbore that serves as a flow path with the potential risk of flow. In other words, unless a tripping operation is carefully controlled, the integrity of the open hole can be compromised.

A drill string can be several thousand feet long, and so performing a tripping operation can take many hours. This time to perform a tripping operation, as well as a subsequent reinsertion of the drill string into the wellbore, can cost significant amounts of money without making any progress in terms of extending the open hole portion of the wellbore. Consequently, there is a lack of incentive to slow the tripping process from a financial perspective.

SUMMARY

In general, in one aspect, the disclosure relates to a casing valve for providing isolation of an open hole section of a wellbore from a cased hole section of the wellbore. The casing valve can include at least one wall forming a cavity, and at least one flexible sleeve disposed proximate to an inner surface of the at least one wall. The casing valve can also include at least one chamber recessed relative to the inner surface of a top end of the at least one wall, where the at least one chamber is disposed between the at least one flexible sleeve and the at least one wall. The casing valve can further include at least one hydraulic channel disposed within the at least one wall and terminating in the at least one hydraulic chamber. The casing valve can also include a first coupling feature disposed at the top end of the at least one wall, where the first coupling feature is configured to couple to a first casing pipe.

In another aspect, the disclosure can generally relate to a casing valve system for providing isolation within a wellbore. The system can include a casing string disposed in a wellbore, where the casing string comprises a first casing pipe. The system can also include a casing valve coupled to a bottom end of the first casing pipe. The casing valve of the system can include at least one wall forming a cavity, and at least one flexible sleeve disposed proximate to an inner surface of the at least one wall, where the flexible sleeve has a normal state and an expanded state. The casing valve of the system can also include at least one chamber recessed relative to the inner surface of a top end of the at least one wall, where the at least one chamber is disposed between the at least one flexible sleeve and the at least one wall. The casing valve of the system can further include at least one hydraulic channel disposed within the at least one wall and terminating in the at least one hydraulic chamber. The casing valve of the system can also include a first coupling feature disposed at the top end of the at least one wall, where the first coupling feature couples to a first complementary coupling feature disposed at the bottom end of the first casing pipe. The system can further include a control line coupled to the at least one hydraulic channel, and a control unit coupled to the control line, where the control unit control a flow and a pressure of the hydraulic material in the control line and the at least one hydraulic channel.

In yet another aspect, the disclosure can generally relate to a method for isolating a section of a wellbore. The method can include receiving hydraulic material in at least one chamber, where the at least one chamber is part of a casing valve disposed within a casing string in the wellbore, where the casing valve comprises at least one wall that forms a cavity. The method can also include repositioning, using the hydraulic material in the at least one chamber, at least one flexible sleeve from a normal state to an expanded state, where the expanded state moves a portion of the at least one flexible sleeve toward a center of the cavity. The method can further include maintaining pressure of the hydraulic material in the at least one chamber to maintain the at least one flexible sleeve in the expanded state.

These and other aspects, objects, features, and embodiments will be apparent from the following description and the appended claims.

BRIEF DESCRIPTION OF THE DRAWINGS

The drawings illustrate only example embodiments of methods, systems, and devices for casing valves and are therefore not to be considered limiting of its scope, as casing valves may admit to other equally effective embodiments. The elements and features shown in the drawings are not necessarily to scale, emphasis instead being placed upon clearly illustrating the principles of the example embodiments. Additionally, certain dimensions or positionings may be exaggerated to help visually convey such principles. In the drawings, reference numerals designate like or corresponding, but not necessarily identical, elements.

DETAILED DESCRIPTION OF EXAMPLE EMBODIMENTS

Figure 1:
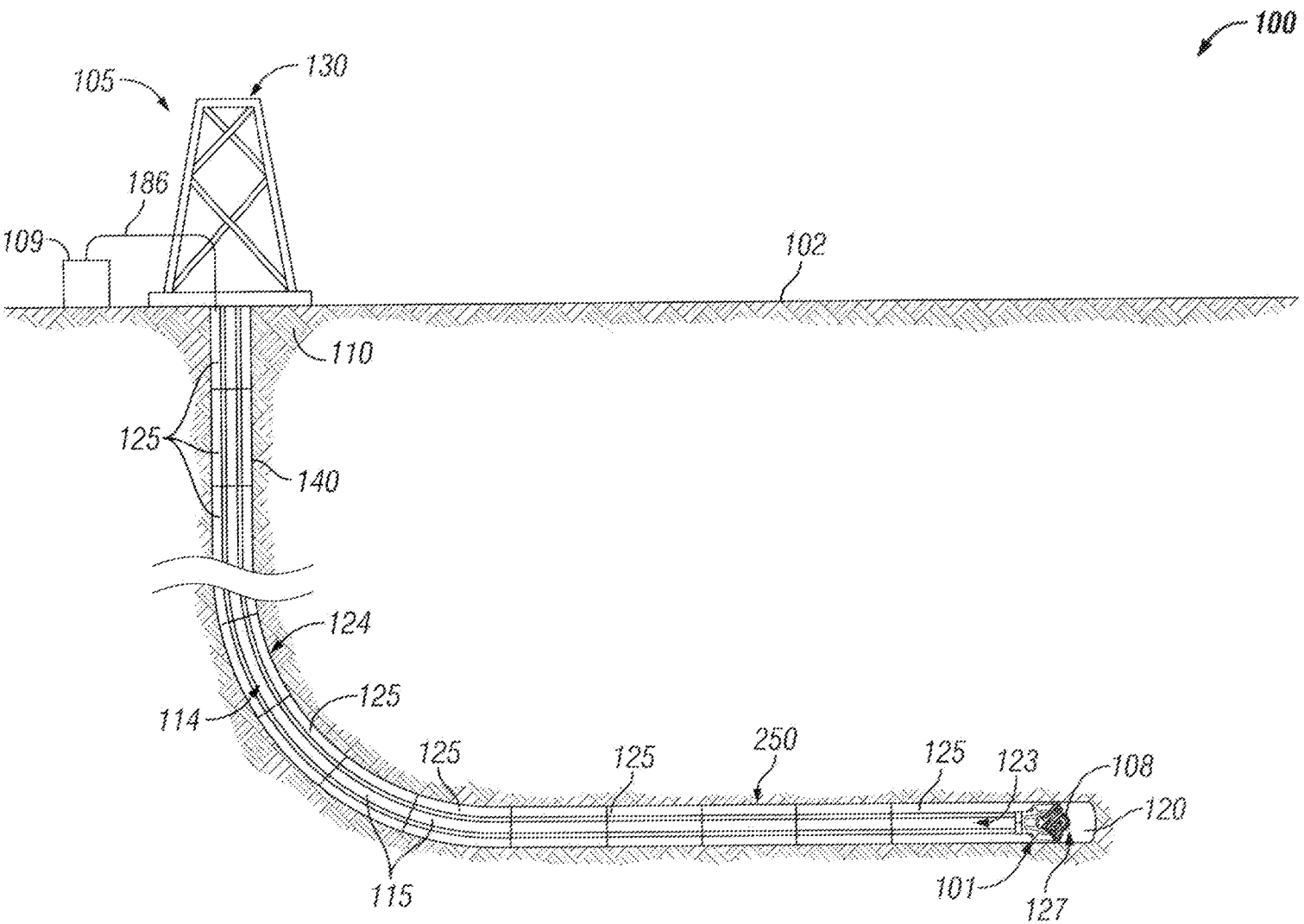
FIG. 1 shows a schematic diagram of a field system in which casing valves can be used in a wellbore in accordance with certain example embodiments.

The example embodiments discussed herein are directed to systems, apparatuses, and methods of casing valves in a wellbore. While the example casing valves shown in the figures and described herein are directed to use in a wellbore, example casing valves can also be used in other applications, aside from a wellbore, in which a casing string and/or a need for isolating a section of pipe can be used. Thus, the examples of casing valves described herein are not limited to use in a wellbore.

Further, while example embodiments described herein use hydraulic material and a pressurized hydraulic system to operate the casing valve, example casing valves can also be operated using other types of systems, such as pneumatic systems. Thus, example embodiments are not limited to the use of hydraulic material and pressurized hydraulic systems. A user as described herein may be any person that is involved with a field operation (including a tripping operation) in a subterranean wellbore for a field system. Examples of a user may include, but are not limited to, a roughneck, a company representative, a drilling engineer, a tool pusher, a service hand, a field engineer, an electrician, a mechanic, an operator, a consultant, a contractor, and a manufacturer's representative.

Any example casing valves, or portions (e.g., components) thereof, described herein can be made from a single piece (as from a mold). When an example casing valve or portion thereof is made from a single piece, the single piece can be cut out, bent, stamped, and/or otherwise shaped to create certain features, elements, or other portions of a component. Alternatively, an example casing valve (or portions thereof) can be made from multiple pieces that are mechanically coupled to each other. In such a case, the multiple pieces can be mechanically coupled to each other using one or more of a number of coupling methods, including but not limited to adhesives, welding, fastening devices, compression fittings, mating threads, and slotted fittings. One or more pieces that are mechanically coupled to each other can be coupled to each other in one or more of a number of ways, including but not limited to fixedly, hingedly, removeably, slidably, and threadably.

Components and/or features described herein can include elements that are described as coupling, fastening, securing, or other similar terms. Such terms are merely meant to distinguish various elements and/or features within a component or device and are not meant to limit the capability or function of that particular element and/or feature. For example, a feature described as a "coupling feature" can couple, secure, fasten, and/or perform other functions aside from merely coupling. In addition, each component and/or feature described herein (including each component of an example casing valve) can be made of one or more of a number of suitable materials, including but not limited to metal, ceramic, rubber, and plastic.

A coupling feature (including a complementary coupling feature) as described herein can allow one or more components and/or portions of an example casing valve (e.g., a sleeve) to become mechanically coupled, directly or indirectly, to another portion (e.g., a wall) of the casing valve. A coupling feature can include, but is not limited to, portion of a hinge, an aperture, a recessed area, a protrusion, a slot, a spring clip, a tab, a detent, and mating threads. One portion of an example casing valve can be coupled to another portion of a casing valve by the direct use of one or more coupling features.

In addition, or in the alternative, a portion of an example casing valve can be coupled to another portion of the casing valve using one or more independent devices that interact with one or more coupling features disposed on a component of the casing valve. Examples of such devices can include, but are not limited to, a pin, a hinge, a fastening device (e.g., a bolt, a screw, a rivet), and a spring. One coupling feature described herein can be the same as, or different than, one or more other coupling features described herein. A complementary coupling feature as described herein can be a coupling feature that mechanically couples, directly or indirectly, with another coupling feature.

Example embodiments of a casing valve can isolate at least a distal portion of a casing string and an open hole within the wellbore beyond the casing string. The example casing valve can allow the drill string (positioned within the cavity of the casing string) to be tripped above the example casing valve with the hydrostatic pressure of the mud column in the cavity of the casing string above the example casing valve to be equal to, greater than (overbalanced), or less than (underbalanced) the open hole pressure below the example casing valve. In certain example embodiments, multiple example casing valves can be part of and/or disposed within the casing string to provide redundancy and/or to isolate various sections of the wellbore that are cased and/or open hole relative to each other.

Example embodiments of casing valves in a wellbore will be described more fully hereinafter with reference to the accompanying drawings, in which example embodiments of casing valves in a wellbore are shown. Casing valves in a wellbore may, however, be embodied in many different forms and should not be construed as limited to the example embodiments set forth herein. Rather, these example embodiments are provided so that this disclosure will be thorough and complete, and will fully convey the scope of casing valves in a wellbore to those of ordinary skill in the art. Like, but not necessarily the same, elements (also sometimes called modules) in the various figures are denoted by like reference numerals for consistency.

Terms such as "first," "second," "top," "bottom," "end," "inner," "outer," and "distal" are used merely to distinguish one component (or part of a component or state of a component) from another. Such terms are not meant to denote a preference or a particular orientation. Also, the names given to various components described herein are descriptive of one embodiments and are not meant to be limiting in any way. Those of ordinary skill in the art will appreciate that a feature and/or component shown and/or described in one embodiment (e.g., in a figure) herein can be used in another embodiment (e.g., in any other figure) herein, even if not expressly shown and/or described in such other embodiment.

Further, if a component of a figure is described but not expressly shown or labeled in that figure, the label used for a corresponding component in another figure can be inferred to that component. Conversely, if a component in a figure is labeled but not described, the description for such component can be substantially the same as the description for the corresponding component in another figure. The numbering scheme for the various components in the figures herein is such that each component is a three digit number and corresponding components in other figures have the identical last two digits.

FIG. 1 shows a schematic diagram of a land-based field system 100 in which casing valves can be used within a subterranean wellbore in accordance with one or more example embodiments. In one or more embodiments, one or more of the features shown in FIG. 1 may be omitted, added, repeated, and/or substituted. Accordingly, embodiments of a field system should not be considered limited to the specific arrangements of components shown in FIG. 1.

Referring now to FIG. 1, the field system 100 in this example includes a wellbore 120 that is formed by a wall 140 in a subterranean formation 110 using field equipment 130. The field equipment 130 can be located above a surface 102, such as ground level for an on-shore application and the sea floor for an off-shore application, and/or within the wellbore 120. The point where the wellbore 120 begins at the surface 102 can be called the entry point. The subterranean formation 110 can include one or more of a number of formation types, including but not limited to shale, limestone, sandstone, clay, sand, and salt. In certain embodiments, a subterranean formation 110 can also include one or more reservoirs in which one or more resources (e.g., oil, gas, water, steam) can be located. One or more of a number of field operations (e.g., drilling, setting casing, extracting downhole resources) can be performed to reach an objective of a user with respect to the subterranean formation 110.

The wellbore 120 can have one or more of a number of segments, where each segment can have one or more of a number of dimensions. Examples of such dimensions can include, but are not limited to, size (e.g., diameter) of the wellbore 120, a curvature of the wellbore 120, a total vertical depth of the wellbore 120, a measured depth of the wellbore 120, and a horizontal displacement of the wellbore 120. The field equipment 130 can be used to create and/or develop (e.g., insert casing pipe, extract downhole materials) the wellbore 120. The field equipment 130 can be positioned and/or assembled at the surface 102. The field equipment 130 can include, but is not limited to, control unit 109 (including a hydraulic operating control line 186, as explained below), a derrick, a tool pusher, a clamp, a tong, drill pipe, a drill bit, example isolator subs, tubing pipe, a power source, and casing pipe.

The field equipment 130 can also include one or more devices that measure and/or control various aspects (e.g., direction of wellbore 120, pressure, temperature) of a field operation associated with the wellbore 120. For example, the field equipment 130 can include a wireline tool that is run through the wellbore 120 to provide detailed information (e.g., curvature, azimuth, inclination) throughout the wellbore 120. Such information can be used for one or more of a number of purposes. For example, such information can dictate the size (e.g., outer diameter) of casing pipe to be inserted at a certain depth in the wellbore 120.

Inserted into and disposed within the wellbore are a number of casing pipe 125 that are coupled to each other to form the casing string 124. In this case, each end of a casing pipe 125 has mating threads disposed thereon, allowing a casing pipe 125 to be mechanically coupled to an adjacent casing pipe 125 in an end-to-end configuration. The casing pipes 125 of the casing string 124 can be mechanically coupled to each other directly or using a coupling device, such as a coupling sleeve. The casing string 124 is not disposed in the entire wellbore 120. Often, the casing string 124 is disposed from approximately the surface 102 to some other point in the wellbore 120. The open hole portion 127 of the wellbore 120 extends beyond the casing string 124 at the distal end of the wellbore 120.

Each casing pipe 125 of the casing string 124 can have a length and a width (e.g., outer diameter). The length of a casing pipe 125 can vary. For example, a common length of a casing pipe 125 is approximately 40 feet. The length of a casing pipe 125 can be longer (e.g., 60 feet) or shorter (e.g., 10 feet) than 40 feet. The width of a casing pipe 125 can also vary and can depend on the cross-sectional shape of the casing pipe 125. For example, when the cross-sectional shape of the casing pipe 125 is circular, the width can refer to an outer diameter, an inner diameter, or some other form of measurement of the casing pipe 125. Examples of a width in terms of an outer diameter can include, but are not limited to, 7 inches, 7-⅝ inches, 8-⅝ inches, 10-¾ inches, 13-⅜ inches, and 14 inches.

The size (e.g., width, length) of the casing string 124 is determined based on the information gathered using field equipment 130 with respect to the wellbore 120. The walls of the casing string 124 have an inner surface that forms a cavity 123 that traverses the length of the casing string 124. Each casing pipe 125 can be made of one or more of a number of suitable materials, including but not limited to stainless steel. In certain example embodiments, the casing pipes 125 are made of one or more of a number of electrically conductive materials. A cavity 123 can be formed by the walls of the casing string 124.

The casing valve 250 can be considered a part of, or separate from, the casing string 124. In such a case, one or more example casing valves 250 can be part of, or disposed within, the casing string 124. A casing valve 250 can be placed at any location along the casing string 124. In any case, the top end of the casing valve 250 can couple to a casing pipe 125. In some cases, if the casing valve 250 is not placed at the end of the casing string 124, the bottom end of the casing valve 250 can couple to another casing pipe 125. In some cases, the portion of the wellbore 120 above the casing valve 250 (between the casing valve and the surface 102) can be called the cased section (or cased hole section) of the wellbore 120, and the portion of the wellbore 120 below the casing valve 250 can be called the open end section of the wellbore 120. Further details of the casing valve 250 are provided below with respect to FIGS. 2 and 3.

A number of tubing pipes 115 that are coupled to each other and inserted inside the cavity 123 formed by the tubing string 114. The collection of tubing pipes 115 can be called a tubing string 114. The tubing pipes 115 of the tubing string 114 are mechanically coupled to each other end-to-end, usually with mating threads. The tubing pipes 115 of the tubing string 114 can be mechanically coupled to each other directly or using a coupling device, such as a coupling sleeve or an isolator sub (both not shown). Each tubing pipe 115 of the tubing string 114 can have a length and a width (e.g., outer diameter). The length of a tubing pipe 115 can vary. For example, a common length of a tubing pipe 115 is approximately 30 feet. The length of a tubing pipe 115 can be longer (e.g., 40 feet) or shorter (e.g., 10 feet) than 30 feet. Also, the length of a tubing pipe 115 can be the same as, or different than, the length of an adjacent casing pipe 125.

The width of a tubing pipe 115 can also vary and can depend on one or more of a number of factors, including but not limited to the target depth of the wellbore 120, the total length of the wellbore 120, the inner diameter of the adjacent casing pipe 125, and the curvature of the wellbore 120. The width of a tubing pipe 115 can refer to an outer diameter, an inner diameter, or some other form of measurement of the tubing pipe 115. Examples of a width in terms of an outer diameter for a tubing pipe 115 can include, but are not limited to, 7 inches, 5 inches, and 4 inches.

In some cases, the outer diameter of the tubing pipe 115 can be such that a gap exists between the tubing pipe 115 and an adjacent casing pipe 125. The walls of the tubing pipe 115 have an inner surface that forms a cavity that traverses the length of the tubing pipe 115. The tubing pipe 115 can be made of one or more of a number of suitable materials, including but not limited to steel.

At the distal end of the tubing string 114 within the wellbore 120 is a bottom hole assembly (sometimes referred to herein as a "BHA") 101. The BHA 101 can include a drill bit 139 at the far distal end. The drill bit 108 is used to extend the open hole portion 127 of the wellbore 120 in the formation 110 by cutting into the formation 110. The BHA 101 can include one or more other components, including but not limited to tubing pipe 115, a measurement-while-drilling tool, and a wrench flat. During a field operation that involves drilling (extending the open hole portion 127 of the wellbore 120), the tubing string 114, including the BHA 101, can be rotated by other field equipment 130.

Figure 2:
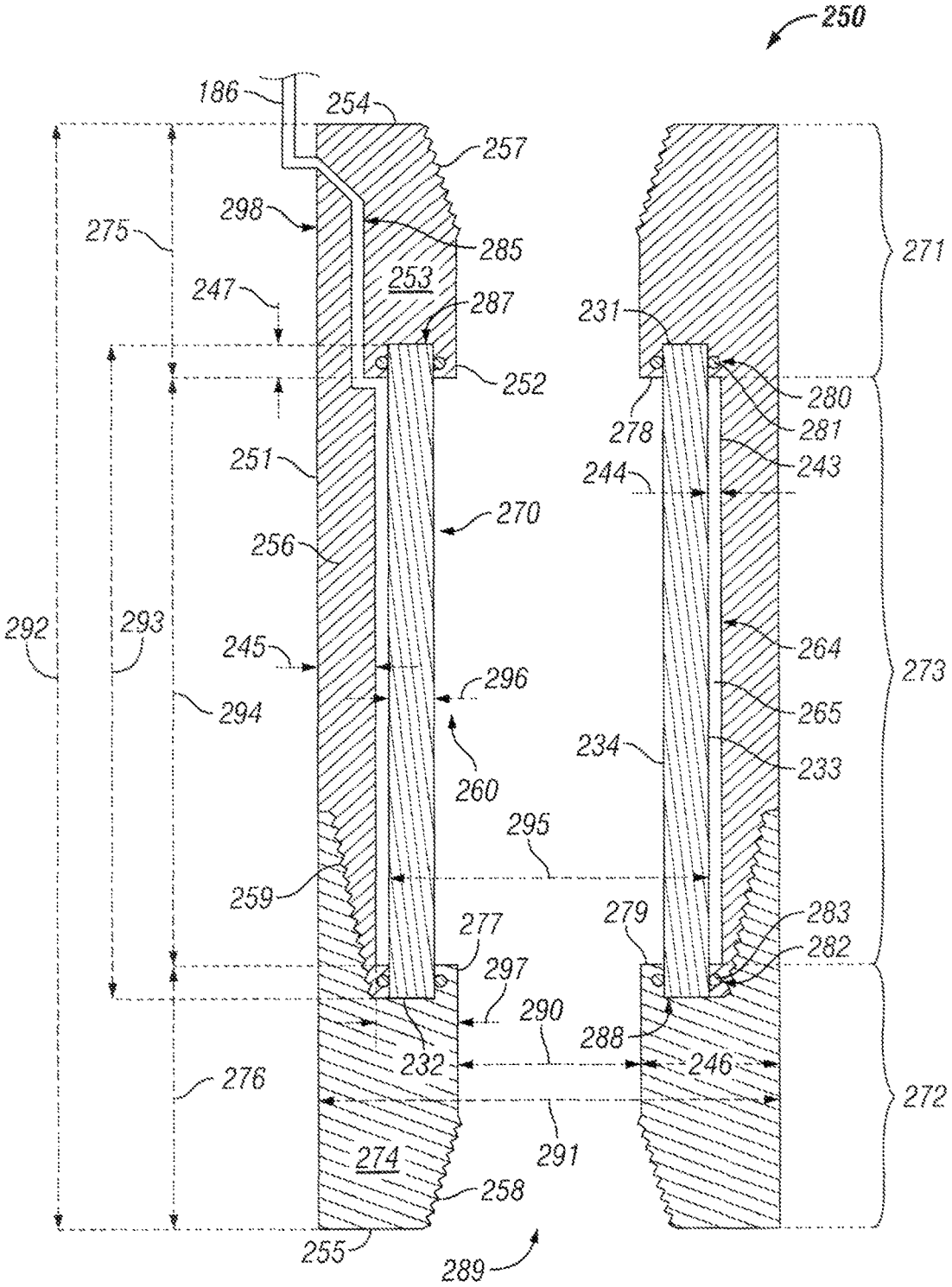
FIG. 2 shows a cross-sectional side view of a casing valve in a normal position in accordance with certain example embodiments.

FIG. 2 shows a cross-sectional side view of a casing valve 250 in a normal position in accordance with certain example embodiments. In one or more embodiments, one or more of the features shown in FIG. 2 may be omitted, added, repeated, and/or substituted. Accordingly, embodiments of a casing valve should not be considered limited to the specific arrangements of components shown in FIG. 2.

Referring to FIGS. 1 and 2, the casing valve 250 can have at least one wall 298 with multiple portions. For example, the wall 298 of the casing valve 250 of FIG. 2 has a top end 271, a bottom end 272, and a middle section 273. The top end 271 and the bottom end 272 can be substantially the same as each other, except as described below. The various portions of the wall 298 of the casing valve 250 can be made from a single piece or multiple pieces. The wall 298 can have a height 292 and a width 291. Each portion of the wall 298 can have a common outer surface 251. A cavity 289 disposed inside of the wall 298 can traverse the height 292 of the wall 298. The cavity 289 can be the same as, or different than, the cavity 123 of the casing string 124.

The top end 271 of the wall 298 of FIG. 2 can have wall portion 253 that includes an inner surface 252, a top surface 254, an outer surface 251, a bottom surface 278, and coupling features 257 disposed between the inner surface 252 and the top surface 254. The inner surface 252 can form the cavity 289 that traverses the height 275 of the top end 271. The inner surface 252 of the top end 271, when viewed cross-sectionally from above, can have one or more of a number of shapes. Examples of such shapes can include, but are not limited to, a circle, an oval, a square, and a hexagon.

In certain example embodiments, the cross-sectional shape formed by the inner surface 252 of the top end 271 can be substantially the same as the cross-sectional shape formed by the inner surface of a casing pipe 125. Similarly, the size (e.g., perimeter) of the cross-sectional area formed by the inner surface 252 of the top end 271 can be substantially the same as the size of the cross-sectional area formed by the inner surface of a casing pipe 125. In this case, the cross-sectional shape formed by the inner surface 252 is a circle having a diameter 290. Likewise, the size and shape of the cross-section formed by the outer surface 251 of the top end 271 can be substantially the same as the size and shape of the cross-section formed by the inner surface of a casing pipe 125.

The top end 271 of the wall 298 can also have at least one hydraulic channel 285 disposed therein. The hydraulic channel 285 is designed to allow hydraulic material to flow therethrough. The hydraulic channel 285 can have one end located (terminate) at an outer edge (e.g., the outer surface 251) of the top end 271. The other end of the hydraulic channel 285 can be located (terminate) at a hydraulic chamber 264 (described below). The hydraulic channel can have any shape and/or dimensions suitable to accommodate the amount of hydraulic material and the pressure used during operation of the casing valve 250.

The hydraulic channel 285 can be configured to receive a hydraulic operating control line 186. In such a case, the hydraulic operating control line 186 can run from the casing valve 250 within the wellbore 120 to the surface 102, where the other end of the hydraulic operating control line 186 is connected to the control unit 109. The control unit 109 can include one or more components that allow a user to control the control valve 250 from the surface 102. Examples of such components of the control unit 109 can include, but are not limited to, a compressor, one or more valves, a pump, piping, and a computer. The hydraulic operating control line 186 can be disposed between the casing string 124 and the wall 140 of the wellbore 120 and/or within the casing string 124.

In certain example embodiments, the top end 271 of the wall 298 also includes at least one channel 287 that is sized and shaped to receive an end of a flexible sleeve 270 (described below). The channel 287 can originate from any surface (in this case, the bottom surface 278) and extend inward by a distance 247. The channel 287 can have one or more of a number of coupling features (hidden from view in FIG. 2) that allow the flexible sleeve 270 to remain affixed within the channel 287 during the pressures and temperatures that the casing valve 250 is exposed to during operation of the casing valve 250.

The top end 271 of the wall 298 can also include at least one additional channel 280 that is located adjacent to the channel 287 within the wall 298 in the top end 271. The channel 280 is sized and shaped to receive a sealing member 281 (e.g., a gasket, an o-ring). The channel 287 can have one or more of a number of coupling features (hidden from view in FIG. 2) that allow the sealing member 281 to remain affixed within the channel 280 during the pressures and temperatures that the casing valve 250 is exposed to during operation of the casing valve 250.

The coupling feature 257 disposed between the inner surface 252 and the top surface 254 can be used to mechanically couple the casing valve 250 to an adjacent casing pipe 125 in the casing string 124. For example, the coupling feature 257 can be mating threads that are configured to complement mating threads on a tubing pipe 115.

The bottom end 272 of the wall 298 of FIG. 2 can have a wall portion 274 that includes an inner surface 277, a top surface 279, the outer surface 251, a bottom surface 255, and coupling features 258 disposed between the inner surface 277 and the bottom surface 255. The inner surface 277 can form the cavity 289 that traverses the height 276 of the bottom end 272. The inner surface 277 of the bottom end 272, when viewed cross-sectionally from above, can have one or more of a number of shapes. Examples of such shapes can include, but are not limited to, a circle, an oval, a square, and a hexagon. The cross-sectional shape formed by the inner surface 277 of the bottom end 272 can be substantially the same as the cross-sectional shape formed by the inner surface 252 of the top end 271. Thus, in this case, the cross-sectional shape formed by the inner surface 277 is a circle having the diameter 290.

In certain example embodiments, the cross-sectional shape formed by the inner surface 277 of the bottom end 272 can be substantially the same as the cross-sectional shape formed by the inner surface of a casing pipe 125. Similarly, the size (e.g., perimeter) of the cross-sectional area formed by the inner surface 277 of the bottom end 272 can be substantially the same as the size of the cross-sectional area formed by the inner surface of a casing pipe 125. Likewise, the size and shape of the cross-section formed by the outer surface 251 of the bottom end 272 can be substantially the same as the size and shape of the cross-section formed by the inner surface of a casing pipe 125.

The bottom end 272 may not have a hydraulic channel, as with the hydraulic channel 285 of the top end 271. In certain example embodiments, the bottom end 272 of the wall 298 includes at least one channel 288 that is sized and shaped to receive an end of a flexible sleeve 270 (described below).

The end of the flexible sleeve 270 received by the channel 288 can be opposite to the end of the flexible sleeve 270 received by the channel 287 of the top end 271. The channel 288 can originate from any surface (in this case, the top surface 279) and extend inward by a distance 247. The channel 288 can have one or more of a number of coupling features (hidden from view in FIG. 2) that allow the flexible sleeve 270 to remain affixed within the channel 288 during the pressures and temperatures that the casing valve 250 is exposed to during operation of the casing valve 250.

The coupling feature 258 disposed between the inner surface 277 and the bottom surface 255 can be used to mechanically couple the casing valve 250 to an adjacent casing pipe 125 in the casing string 124. For example, the coupling feature 258 can be mating threads that are configured to complement mating threads on a tubing pipe 115.

In certain example embodiments, the middle section 273 of the wall 298 is disposed between the top end 271 and the bottom end 272. The middle section 273 can include a wall portion 256 that has the outer surface 251 and an inner surface 243. The wall portion 256 can have a height 294 and a thickness 245. The top and bottom of the wall portion 256 can be merged with (e.g., form a single piece with) the wall portion 253 of the top end 271 and/or the wall portion 274 of the bottom end 272, respectively. Alternatively, the wall portion 256 can be a separate piece that is coupled to the wall portion 253 and/or the wall portion 274 using one or more coupling features. For example, as shown in FIG. 2, the wall portion 256 of the middle section 273 is coupled to the wall portion 274 of the bottom end 272 using coupling feature 259, where coupling feature 259 is mating threads. In such a case, a portion of where the wall portions meet can form a feature (e.g., channel 287) of the casing valve 250. The thickness 245 (width) of the wall 254 can be less than the thickness 246 of the wall portion 274 and the wall portion 253.

Since the middle section 273 shares the outer surface 251 with the top end 271 and the bottom end 272, the inner surface 243 is recessed by a distance 297 relative to the inner surface 252 of the top end 271 and the inner surface 277 of the bottom end 272. In certain example embodiments, the inner surface 243 of the wall portion 256 is recessed relative to the channel 287 of the top end 271 and the channel 288 of the bottom end 272. The inner surface 243 can form the cavity 289 that traverses the height 294 of the middle section 273. The space formed by the inner surface 243 of the middle section 273, the bottom surface 278 of the top end 271, and the top surface 279 of the bottom end 272 can be called the recessed area 260.

The inner surface 243 of the middle section 273, when viewed cross-sectionally from above, can have one or more of a number of shapes. Examples of such shapes can include, but are not limited to, a circle, an oval, a square, and a hexagon. The cross-sectional shape formed by the inner surface 243 of the middle section 273 can be substantially the same as the cross-sectional shape formed by the inner surface 252 of the top end 271 and/or the inner surface 277 of the bottom end 272. Thus, in this case, the cross-sectional shape formed by the inner surface 243 is a circle having the diameter 295. Alternatively, the cross-sectional shape formed by the inner surface 243 of the middle section 273 can be different than the cross-sectional shape formed by the inner surface 252 of the top end 271 and/or the inner surface 277 of the bottom end 272.

In certain example embodiments, at least a portion of the hydraulic channel 285 can be disposed within the wall portion 256 of the middle section 273. For example, as shown in FIG. 2, the distal portion of the hydraulic channel 285, where the hydraulic channel 285 terminates at the inner surface 243, is disposed within the wall portion 256 of the middle section 273. Alternatively, the hydraulic channel 285 may not be disposed in any portion of the wall portion 256 of the middle section 273. The middle section 273 can be disposed at any point along the inner surface 252 of the wall portion 253. For example, as shown in FIG. 2, the middle section 273 can be approximately centered along the height 292 of the wall 298.

In certain example embodiments, the casing valve 250 can also include one or more flexible sleeves 270. Each flexible sleeve 270 can be disposed proximate to the inner surface 243 of the middle section 273. For example, as shown in FIG. 2, one end (e.g., the top end) of the flexible sleeve 270 can be disposed in the channel 287 in the top end 271 of the wall 298, and the opposite end (e.g., the top end) of the flexible sleeve 270 can be disposed in the channel 288 in the bottom end 272 of the wall 298.

The flexible sleeve 270 can be fixedly coupled to the wall 298 so as to withstand the temperatures, pressures, turbulence, and other conditions that exist in the cavity 289 during field operations and/or operation of the casing valve 250. The sealing member 281 disposed in the channel 280 of the top end 271 can be adjacent to the top end of the flexible sleeve 270, and the sealing member 283 disposed in the channel 282 of the bottom end 272 can be adjacent to the bottom end of the flexible sleeve 270.

The flexible sleeve 270 has a normal state (as shown in FIG. 2) and an expanded state (as shown below with respect to FIG. 3). At least a portion of the flexible sleeve 270 is disposed in the recessed area 260. For example, as shown in FIG. 2, when the flexible sleeve 270 is in a normal state, the portion of the flexible sleeve 270 that is not disposed in the channel 287 and the channel 288 is disposed in the recessed area 260. As discussed above, the recessed area 260 has a width 297.

In certain example embodiments, the flexible sleeve 270 has a top surface 231, a bottom surface 232, an outer surface 233, and an inner surface 234. The flexible sleeve 270 can have a height 293 and a thickness 296 (width). The thickness 296 of the flexible sleeve 270 can be substantially the same as the width of the channel 287 and the channel 288. The flexible sleeve 270 can be made of one or more of a number of materials that allow for repeated expansion and contraction of the flexible sleeve 270 while also being subjected to the temperatures, pressures, turbulence, and other conditions that exist in the cavity 289 during field operations and/or operation of the casing valve 250. For example, the flexible sleeve 270 can be an elastomeric mesh sleeve that is made of rubber and aluminum.

In certain example embodiments, the space formed by the inner surface 243 of the middle section 273, the bottom surface 278 of the top end 271, the top surface 279 of the bottom end 272, and the flexible sleeve 270 is the hydraulic chamber 264. The flexible sleeve 270 and the hydraulic chamber 264 can both disposed in the recessed area 260. The hydraulic chamber 264 has a height 294 (that is substantially the same as the height 294 of the middle section 273) and a width 244. The width 244 of the hydraulic chamber 264 varies as the casing valve 250 operates.

When the flexible sleeve 270 is in a relaxed state, as shown in FIG. 2, the hydraulic chamber 264, filled with hydraulic material 265, is a minimal size. In certain example embodiments, the hydraulic chamber 264 is filled with one or more of a number of hydraulic materials 265. The hydraulic material can be a liquid (fluid), a gas (in which case, the hydraulic material can also be called a pneumatic material), or have any other suitable state. A non-limiting example of a hydraulic material is oil.

Figure 3:
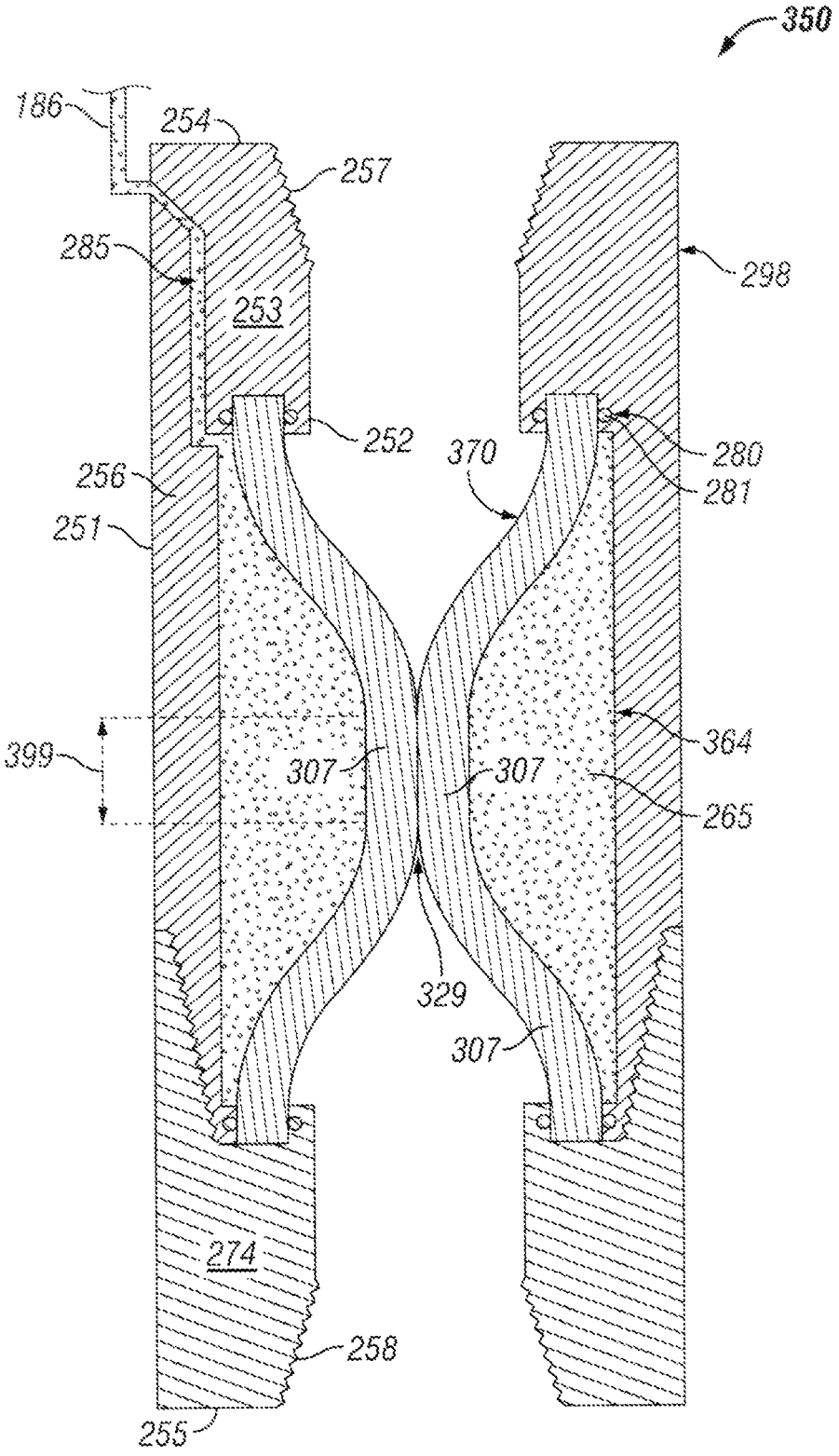
FIG. 3 shows a cross-sectional side view of the casing valve of FIG. 2 in an expanded position in accordance with certain example embodiments.

FIG. 3 shows a cross-sectional side view of the casing valve 350 of FIG. 2 in an expanded position in accordance with certain example embodiments. In one or more embodiments, one or more of the features shown in FIG. 3 may be omitted, added, repeated, and/or substituted. Accordingly, embodiments of a casing valve should not be considered limited to the specific arrangements of components shown in FIG. 3.

Referring to FIGS. 1-3, the casing valve 350 is shown in an expanded position. In other words, the control unit 109 has filled the chamber 364 with additional hydraulic material 265 (increases the volume of the hydraulic material 265 within the chamber 364), which forces the flexible sleeve 370 to expand (repositions the flexible sleeve 370) into the cavity 289 of the casing valve 350. In certain example embodiments, the hydraulic material 265 is pressurized in order to be injected over such a great distance (e.g., thousands of feet) from the control unit 109 through the hydraulic channel 285 and the hydraulic operating control line 186 to the casing valve 350 and to provide a sufficient amount of force to push the flexible sleeve 370 inward toward the cavity 289.

In such a case, the size of the chamber 364 when the flexible sleeve 370 is in an expanded state, as shown in FIG. 3, is larger than the size of the chamber 264 when the flexible sleeve 270 is in a normal state, as shown in FIG. 2. Further, the chamber 364 of FIG. 3 has more hydraulic material 265 compared to the chamber 264 of FIG. 2. In some cases, the hydraulic material 265 can have a low density (relative to the density of the fluid in the cavity 289) and/or other characteristics that allow for effective manipulation of the position of the flexible sleeves 370.

In certain example embodiments, once the control unit 109 stops injecting the hydraulic material 265 into the chamber 364, the control unit 109 maintains the hydraulic pressure in the hydraulic channel 285 and the hydraulic operating control line 186 so that the hydraulic material 265 in the chamber 364 continues to force the flexible sleeve 370 to remain in an expanded position. When the flexible sleeve 370 is in an expanded position, a portion 307 of the flexible sleeve 370 can make contact with itself (if there is only one flexible sleeve 370 disposed proximate to the entire perimeter of middle portion 272 of the wall 298) or with a corresponding portion 307 of another flexible sleeve 370 (if the casing valve 350 has multiple flexible sleeves). As a result, a seal 329 is formed so that two different environments can exist within the wellbore 120, with one environment above the seal 329 (between the seal 329 and the surface 102) and one environment below the seal 329 (between the seal 329 and the open hole portion 127 of the wellbore 120.

The seal 329 can create a hydraulic barrier at a depth in the wellbore 120 where the casing valve 350 is installed to prevent flow within the wellbore 120 (e.g., part of the casing string 124) from underneath the casing valve 350. For example, when performing a tripping operation (extracting the tubing string 114 from the wellbore 120), the seal 329 formed by the portion 307 of the flexible sleeve 370 can substantially maintain the integrity of the open hole portion 127 of the wellbore 120. The seal 329 can have a length 399 that is less than the length 293 of the flexible sleeve 370. In some cases, the length 399 (e.g., four inches) of the seal 329 can be significantly less than the length 293 (e.g., eight feet) of the flexible sleeve 370.

The casing valve 350 can be designed to the same or similar rating as the rating of the casing string 124. Alternatively, the casing valve 350 can be designed to a different rating compared to the rating of the casing string 124. The differential rating of the casing valve 350 can vary based on one or more of a number of factors, including but not limited to valve design, closing dimensions, and safe operating hydraulic pressure of the casing valve 350. In certain example embodiments, the control unit 109 monitors and controls the pressure and volume of the hydraulic material 265 to differentiate the expanded position of the flexible sleeve 370, which corresponds to a closed position of the casing valve 350.

Figure 4:
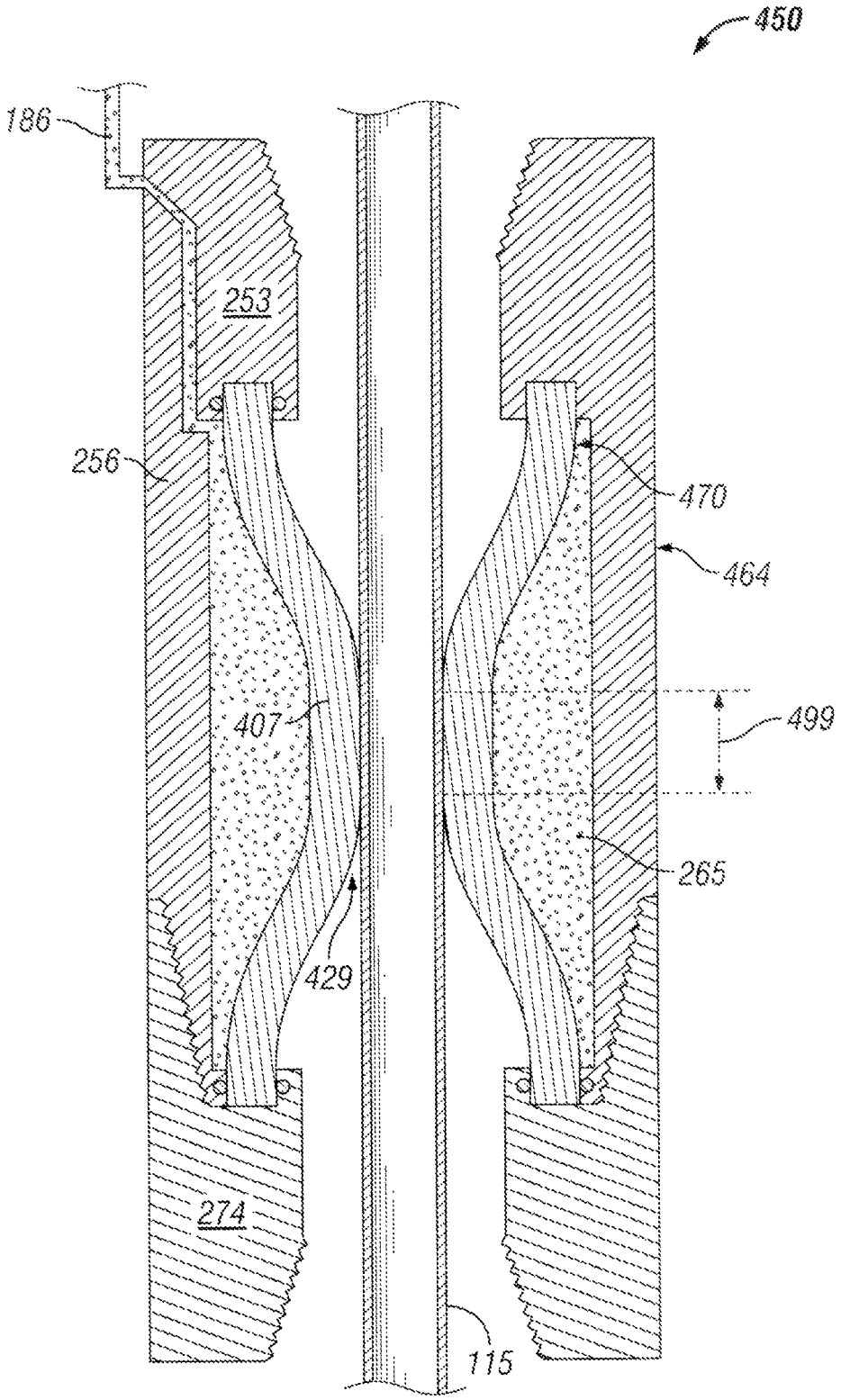
FIG. 4 shows a cross-sectional side view of the casing valve of FIG. 2 in another expanded position in accordance with certain example embodiments.

In addition, as shown in FIG. 4, the casing valve 450 can seal off against portions of the tubing string 114 that are disposed within the cavity 289 of the casing valve 450. Specifically, FIG. 4 shows a cross-sectional side view of the casing valve 450 of FIG. 2 in an expanded position in accordance with certain example embodiments. In one or more embodiments, one or more of the features shown in FIG. 4 may be omitted, added, repeated, and/or substituted. Accordingly, embodiments of a casing valve should not be considered limited to the specific arrangements of components shown in FIG. 4.

Referring to FIGS. 1-4, the expanded position of the flexible sleeve 470 of the casing valve 450 in FIG. 4 is different than the expanded position of the flexible sleeve 370 of the casing valve 350 in FIG. 3. Specifically, the length 499 of the seal 429 between the portion 407 of the flexible sleeve 470 and the tubing pipe 115 of the tubing string 114 can be greater than the length 399 of the seal 329 in FIG. 3. This is because the flexible sleeve 470 travels a smaller distance into the cavity 289 before the seal 429 is formed relative to the distance into the cavity 289 that the flexible sleeve 370 in FIG. 3 travels to create the seal 329.

As a result, less hydraulic material 265 may be needed in the chamber 464 to create the seal 429 compared to the amount of hydraulic material 265 in the chamber 364 to create the seal 329. Also, the shape of the chamber 464 when the flexible sleeve 470 is in the expanded position can be different than the shape of the chamber 364 when the flexible sleeve 370 is in the expanded position. The seal 429 created by the casing valve 450 of FIG. 4 can provide isolation within the wellbore 120 when conducting repairs on field equipment 130 at the surface while at least a portion of the tubing string 114 is held in the cavity 289 within the wellbore 120.

For either case shown in FIG. 3 or FIG. 4, the flexible sleeve 370 and the flexible sleeve 470 can revert to (be repositioned into) its normal state by removing or reducing the hydraulic pressure in the hydraulic channel 285 and the hydraulic operating control line 186 so that the hydraulic material 265 flows out of the chamber 364. In such a case, the hydraulic pressure can be removed or reduced by the control unit 109. The low density of the hydraulic material 265 relative to the higher density of the fluid in the cavity 289 forces (repositions) the flexible sleeve (e.g., flexible sleeve 370, flexible sleeve 470) back toward the wall portion 256 of the wall 298 of the casing valve.

Figure 5:
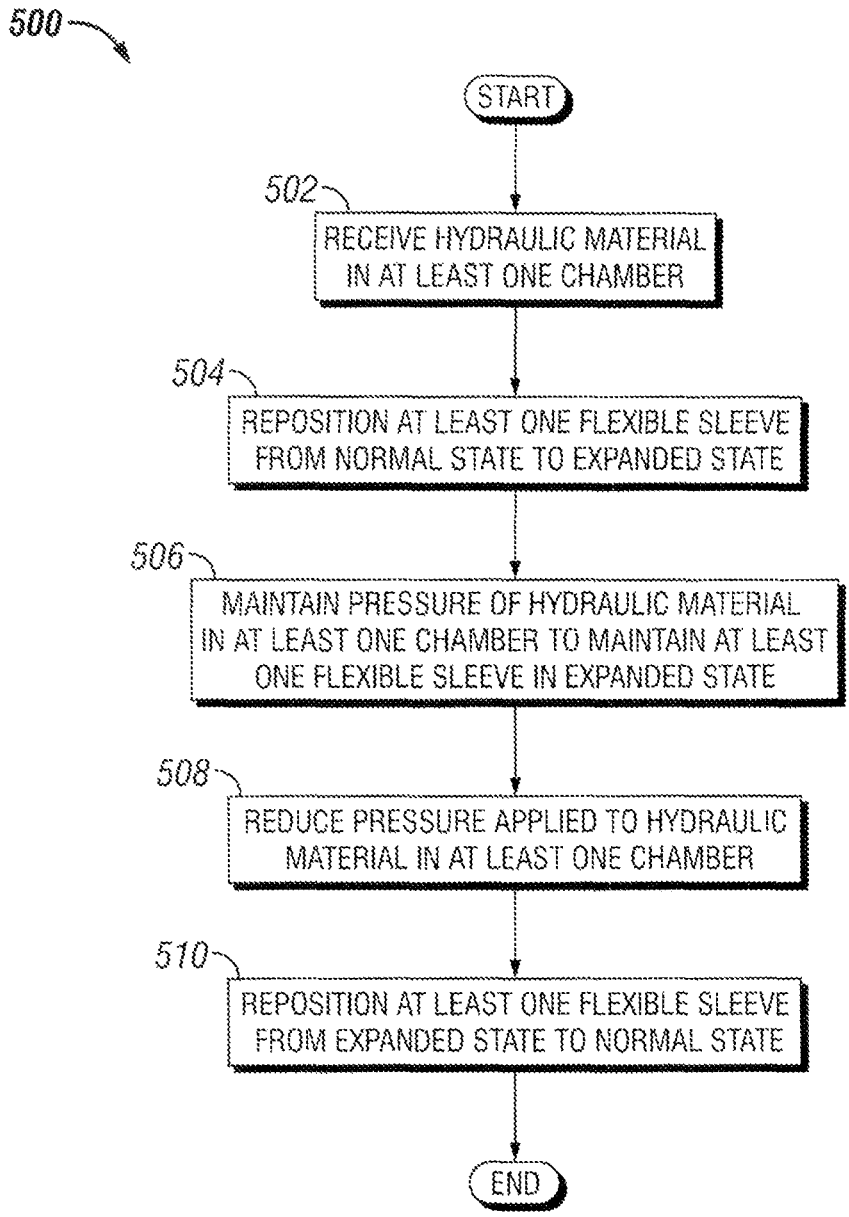
FIG. 5 shows a flowchart of a method for isolating a section of a wellbore using a casing valve in accordance with certain example embodiments.

FIG. 5 is a flowchart presenting a method 500 for isolating a section of a wellbore using a casing valve in accordance with certain example embodiments. While the various steps in this flowchart are presented and described sequentially, one of ordinary skill will appreciate that some or all of the steps may be executed in different orders, may be combined or omitted, and some or all of the steps may be executed in parallel. Further, in one or more of the example embodiments, one or more of the steps described below may be omitted, repeated, and/or performed in a different order. In addition, a person of ordinary skill in the art will appreciate that additional steps not shown in FIG. 5, may be included in performing this method. Accordingly, the specific arrangement of steps should not be construed as limiting the scope.

Referring now to FIGS. 1-5, the example method 500 begins at the START step and proceeds to step 502, where hydraulic material 265 is received in at least one chamber 264. In certain example embodiments, the at least one chamber 264 is part of a casing valve 250 disposed within a casing string 124 in the wellbore 120. The casing valve 250 can include at least one wall 298 that forms a cavity 289. The casing valve 250 can be a part of the casing string 124. Alternatively, the casing valve 250 can be coupled to the distal end of the casing string 124, or in between casing pipe 125 of the casing string 124. The hydraulic material 265 can be delivered to the chamber 264 by the control unit 109 using the hydraulic operating control line 186 and the hydraulic channel 285.

In step 504, at least one flexible sleeve 370 is repositioned from a normal state to an expanded state. The flexible sleeve 370 can be repositioned using the hydraulic material 265 in the at least one chamber 364. For example, additional hydraulic material 265 can flow into the chamber 364, forcing the flexible sleeve 370 to expand outward into the cavity 289. The expanded state moves a portion 307 of the at least one flexible sleeve 370 toward a center of the cavity.

In step 506, pressure of the hydraulic material 265 is maintained in the at least one chamber 364 to maintain the at least one flexible sleeve 370 in the expanded state. The pressure of the hydraulic material 265 can be maintained by the control unit 109, acting through the hydraulic operating control line 186 and the hydraulic channel 285. By maintaining the pressure of the hydraulic material 265 in the at least one chamber 364, the hydraulic material 265 continues applying a force on the at least one flexible sleeve 370 toward the cavity 289 of the casing valve 350 that is sufficient to overcome the force applied by the fluids, air, and other elements in the cavity 289 against the flexible sleeve 370. This keeps the flexible sleeve 370 in the expanded state.

If there is tubing pipe 115 in the cavity 289 when the flexible sleeve 470 is in the expanded state, then a portion 407 of the flexible sleeve 470 abuts against (physically contacts) the tubing pipe 115 of the tubing string 114 to create a seal 429. The seal 429 isolates (for example, in terms of pressure) the portion of the cavity 289 above the seal 429 from the portion of the cavity 289 below the seal 429. If there is no tubing pipe 115 in the cavity 289 when the flexible sleeve 370 is in the expanded state, then a portion 307 of the flexible sleeve 370 abuts against (physically contacts) itself and/or a corresponding portion 307 of another flexible sleeve 370 to create a seal 329.

In step 508, the pressure applied to the hydraulic material 265 in the at least one chamber 370 is reduced. Reducing the pressure applied to the hydraulic material 265 in the chamber 370 can include lowering the pressure applied to the hydraulic material 265, removing the pressure applied to the hydraulic material 265, and/or applying a negative pressure to (sucking out) the hydraulic material 265. Reducing the pressure applied to the hydraulic material 265 can be controlled by the control unit 109.

In step 510, the at least one flexible sleeve 270 is repositioned from the expanded state to the normal state. The sleeve 270 can be repositioned from the expanded state to the normal state by removing some or all of the hydraulic material 265 from the at least one chamber 264. Removing the hydraulic material 265 from the at least one chamber 264 can occur as a natural result of reducing the pressure applied to the hydraulic material 265 in the chamber 370. The normal state of the sleeve 270 positions the portion 307 of the at least one flexible sleeve 270 toward the at least one wall portion 256 of the casing valve 250. Once step 510 is completed, the process ends with the END step.

By performing the method 500 of FIG. 5, the casing valve 250 can be used in one or more of a number of applications that requires isolating (e.g., in terms of pressure) portions of a wellbore 120. For example, embodiments of a casing valve 250 described herein can isolate at least a distal portion of a casing string 124 and an open hole portion 127 of the wellbore 120 beyond the casing string 124. The casing valve 250 can allow the tubing string 114 (including the BHA 101) to be tripped above the casing valve 250 with the hydrostatic pressure of the mud column in the cavity 123 of the casing string 124 above the casing valve 250 to be equal to, greater than (overbalanced), or less than (underbalanced) the open hole pressure below the casing valve 250. In certain example embodiments, multiple casing valves 250 can be part of and/or disposed along the length of the casing string 124 to provide redundancy and/or to isolate various sections of the wellbore 120 that are cased and/or open hole relative to each other.

The systems, methods, and apparatuses described herein allow for creating a seal within a casing string within a wellbore for the purpose of isolating one portion of the wellbore from the other portion of the wellbore. Example embodiments can create a seal against a casing pipe, against various portions of the flexible sleeve, and/or against any other suitable component of a field system. By isolating portions of the wellbore, the integrity of the wellbore (particularly the open hole portion of the wellbore) can be maintained. In addition, example embodiments help promote safety of personnel and equipment during a field operation, such as tripping and maintenance.

Although embodiments described herein are made with reference to example embodiments, it should be appreciated by those skilled in the art that various modifications are well within the scope and spirit of this disclosure. Those skilled in the art will appreciate that the example embodiments described herein are not limited to any specifically discussed application and that the embodiments described herein are illustrative and not restrictive. From the description of the example embodiments, equivalents of the elements shown therein will suggest themselves to those skilled in the art, and ways of constructing other embodiments using the present disclosure will suggest themselves to practitioners of the art. Therefore, the scope of the example embodiments is not limited herein.

What is claimed is:

1. A casing valve system for providing isolation of an open hole section of a wellbore from a cased hole section of the wellbore, the casing valve system comprising:

a casing string disposed in the wellbore, wherein the casing string comprises a first casing pipe; and a casing valve coupled to the first casing pipe, wherein the casing valve comprises:

at least one wall forming a cavity;

at least one flexible sleeve disposed proximate to an inner surface of the at least one wall;

at least one chamber recessed relative to the inner surface of a top end of the at least one wall, wherein the at least one chamber is disposed between and defined by the at least one flexible sleeve and the at least one wall;

at least one hydraulic channel disposed within the at least one wall and terminating in the at least one hydraulic chamber; and a first coupling feature disposed at the top end of the at least one wall, wherein the first coupling feature is configured to couple to the first casing pipe disposed at a distal end of the cased hole section within the wellbore, wherein the at least one flexible sleeve, when forced toward the cavity and away from the at least one chamber by hydraulic material flowing through the at least one hydraulic channel into the at least one hydraulic chamber, is configured to abut against an object in the cavity.

2. The casing valve of claim 1, further comprising:

a second coupling feature disposed at a bottom end of the at least one wall, wherein the second coupling feature is configured to couple to a second casing pipe of the casing string.

3. The casing valve of claim 1, wherein a portion of the at least one flexible sleeve is disposed within at least one recessed area relative to the inner surface of a top end of the at least one wall.

4. The casing valve of claim 1, wherein the at least one wall comprises at least one first channel disposed therein, wherein the at least one first channel has an end of the at least one flexible sleeve disposed therein.

5. The casing valve of claim 4, further comprising:

at least one sealing member disposed adjacent to the end of the at least one flexible sleeve.

6. The casing valve of claim 5, wherein the at least one sealing member is disposed within at least one second channel, wherein the at least one second channel is disposed in the at least one wall adjacent to the at least one first channel.

7. The casing valve of claim 1, wherein the at least one hydraulic channel is configured to receive a hydraulic operating control line.

8. The casing valve of claim 1, wherein the inner surface of the top end of the at least one wall forms a casing valve inner perimeter that is substantially the same as a casing pipe inner perimeter of the first casing pipe.

9. The casing valve of claim 1, wherein the at least one flexible sleeve comprises an elastomeric mesh material.

10. A casing valve system for providing isolation within a wellbore, the casing valve system comprising:

a casing string disposed in the wellbore, wherein the casing string comprises a first casing pipe;

a casing valve coupled to a bottom end of the first casing pipe, wherein the casing valve comprises:

at least one wall forming a cavity;

at least one flexible sleeve disposed proximate to an inner surface of the at least one wall, wherein the flexible sleeve has a normal state and an expanded state;

at least one chamber recessed relative to the inner surface of a top end of the at least one wall, wherein the at least one chamber is disposed between and defined by the at least one flexible sleeve and the at least one wall;

at least one hydraulic channel disposed within the at least one wall and terminating in the at least one hydraulic chamber; and a first coupling feature disposed at the top end of the at least one wall, wherein the first coupling feature couples to a first complementary coupling feature disposed at the bottom end of the first casing pipe, wherein the first casing pipe is disposed at a distal end of the casing string within the wellbore;

a control line coupled to the at least one hydraulic channel; and a control unit coupled to the control line, wherein the control unit controls a flow and a pressure of hydraulic material in the control line and the at least one hydraulic channel, wherein the at least one flexible sleeve, when forced toward the cavity and away from the at least one chamber by the hydraulic material flowing through the at least one hydraulic channel into the at least one hydraulic chamber, is configured to abut against an object in the cavity.

11. The casing valve system of claim 10, further comprising:

a tubing string disposed within the casing string, wherein the tubing string is removed from the cavity of the casing valve prior to when the at least one flexible sleeve is moved from the normal state to the expanded state.

12. The casing valve system of claim 10, further comprising: a tubing string disposed within the casing string, wherein the tubing string is, at least in part, disposed within the cavity of the casing valve when the at least one flexible sleeve is moved from the normal state to the expanded state.

13. The casing valve system of claim 10, wherein a first portion of the inner surface of the at least one wall is recessed relative to a second portion of an inner surface of the at least one wall, wherein the first portion of the inner surface of the at least one wall forms, in part, the at least one chamber.

14. The casing valve system of claim 13, wherein the second portion of the inner surface of the at least one wall has a perimeter that is substantially the same as a casing perimeter of an inner surface of the first casing pipe.

15. The casing valve system of claim 10, wherein the casing string further comprises a second casing pipe, wherein the casing valve further comprises a second coupling feature disposed at a bottom end of the at least one wall, wherein the second coupling feature couples to a second complementary coupling feature disposed at the top end of the second casing pipe.

16. A method for isolating a section of a wellbore, the method comprising:

receiving hydraulic material in at least one chamber, wherein the at least one chamber is part of a casing valve disposed within and at a distal end of a casing string in the wellbore, wherein the casing valve comprises at least one wall that forms a cavity, the at least one chamber recessed relative to the inner surface of a top end of the at least one wall;

repositioning, using the hydraulic material in the at least one chamber, at least one flexible sleeve from a normal state to an expanded state, wherein a portion of the at least one flexible sleeve, when the at least one flexible sleeve is in the expanded state, is positioned toward a center of the cavity; and maintaining pressure of the hydraulic material in the at least one chamber to maintain the at least one flexible sleeve in the expanded state, wherein the at least one chamber is formed by the at least one wall and the at least one flexible sleeve.

17. The method of claim 16, further comprising:

reducing the pressure applied to the hydraulic material in the at least one chamber; and repositioning, by removing the hydraulic material from the at least one chamber, the at least one flexible sleeve from the expanded state to the normal state, wherein the normal state positions the portion of the at least one flexible sleeve toward the at least one wall of the casing valve.

18. The method of claim 16, wherein the expanded state comprises physically contacting the portion of the at least one flexible sleeve against another portion of the at least one flexible sleeve within the cavity.

19. The method of claim 16, wherein the expanded state comprises physically contacting the portion of the at least one flexible sleeve against a tubing string disposed within the cavity.

* * * * *